US011690395B2

(12) United States Patent
Mishra et al.

(10) Patent No.: US 11,690,395 B2
(45) **Date of Patent: *Jul. 4, 2023**

(54) GAMMA CYCLODEXTRIN FLAVORING-RELEASE ADDITIVES

(71) Applicant: Philip Morris USA Inc., Richmond, VA (US)

(72) Inventors: Munmaya K. Mishra, Manakin Sabot, VA (US); Susan E. Wrenn, Chesterfield, VA (US); Jay A. Fournier, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 28 days.

This patent is subject to a terminal disclaimer.

(21) Appl. No.: 16/724,578

(22) Filed: Dec. 23, 2019

(65) Prior Publication Data

US 2020/0120971 A1 Apr. 23, 2020

Related U.S. Application Data

(63) Continuation of application No. 15/583,462, filed on May 1, 2017, now Pat. No. 10,537,131, which is a (Continued)

(51) Int. Cl.
*A24B 15/16* (2020.01)
*A24B 15/28* (2006.01)
(Continued)

(52) U.S. Cl.
CPC ..... *A24B 15/16* (2013.01); *A24B 15/283* (2013.01); *A24B 15/284* (2013.01); *A24D 1/20* (2020.01); *A24F 40/10* (2020.01); *A24C 5/01* (2020.01)

(58) Field of Classification Search
None
See application file for complete search history.

(56) References Cited

U.S. PATENT DOCUMENTS 3,006,347 A 10/1961 Keaton
3,047,431 A 7/1962 Bavley et al.
(Continued)

FOREIGN PATENT DOCUMENTS

EP 0503795 A2 9/1992
WO WO-91/09599 A1 7/1991
(Continued)

OTHER PUBLICATIONS

International Preliminary Report on Patentability dated Aug. 12, 2008 for PCT/IB2007/001770.
(Continued)

*Primary Examiner* — Phu H Nguyen
(74) *Attorney, Agent, or Firm* — Harness, Dickey & Pierce, P.L.C.

(57) ABSTRACT

Electrically heated cigarettes used in an electrical smoking system include a flavoring-release additive and sorbent effective to remove one or more gas-phase constituents of mainstream tobacco smoke. The flavoring-release additive includes gamma cyclodextrin and at least one flavoring. Flavoring is released in a cigarette upon the flavoring-release additive reaching at least a minimum temperature during smoking. The flavoring-release additive can have various forms including, for example, powder and films.

17 Claims, 9 Drawing Sheets

Related U.S. Application Data continuation of application No. 14/519,792, filed on Oct. 21, 2014, now Pat. No. 9,668,519, which is a continuation of application No. 12/791,614, filed on Jun. 1, 2010, now Pat. No. 8,864,909, which is a continuation of application No. 11/702,617, filed on Feb. 6, 2007, now abandoned.

(60) Provisional application No. 60/771,462, filed on Feb. 9, 2006.

(51) Int. Cl.

| | |
|---|---|
| ***A24F 40/10*** | (2020.01) |
| ***A24D 1/20*** | (2020.01) |
| ***A24C 5/01*** | (2020.01) |

(56) References Cited

U.S. PATENT DOCUMENTS

| | | | | |
|---|---|---|---|---|
| 3,236,244 | A | | 2/1966 | Irby, Jr. et al. |
| 3,288,146 | A | | 11/1966 | Bavley et al. |
| 3,344,796 | A | | 10/1967 | Yamaji et al. |
| 3,426,011 | A | | 2/1969 | Parmerter et al. |
| 3,972,335 | A | | 8/1976 | Tiggelbeck et al. |
| 4,715,390 | A | | 12/1987 | Nichols et al. |
| 5,137,034 | A | | 8/1992 | Perfetti et al. |
| 5,144,964 | A | | 9/1992 | Demain |
| 5,335,678 | A | | 8/1994 | Andersson |
| 5,388,594 | A | | 2/1995 | Counts et al. |
| 5,499,636 | A | | 3/1996 | Baggett, Jr. et al. |
| 5,543,424 | A | | 8/1996 | Carlsson et al. |
| 5,666,976 | A | | 9/1997 | Adams et al. |
| 5,674,854 | A | * | 10/1997 | Bodley ..... A61K 31/195 514/58 |
| 5,692,525 | A | | 12/1997 | Counts et al. |
| 5,692,526 | A | | 12/1997 | Adams et al. |
| 5,915,387 | A | | 6/1999 | Baggett, Jr. et al. |
| 5,988,176 | A | | 11/1999 | Baggett, Jr. et al. |
| 6,026,820 | A | | 2/2000 | Baggett, Jr. et al. |
| 6,261,540 | B1 | | 7/2001 | Nelson |
| 6,280,761 | B1 | | 8/2001 | Santus |
| 6,325,859 | B1 | | 12/2001 | De Roos et al. |
| 6,596,263 | B1 | | 7/2003 | Schoon et al. |
| 8,864,909 | B2 | | 10/2014 | Mishra et al. |
| 2004/0129280 | A1 | * | 7/2004 | Woodson ..... A24D 1/20 131/194 |
| 2005/0000528 | A1 | | 1/2005 | Bereman |
| 2005/0172976 | A1 | | 8/2005 | Newman et al. |

FOREIGN PATENT DOCUMENTS

| | | | |
|---|---|---|---|
| WO | WO-91/18525 | A1 | 12/1991 |
| WO | WO-2001/80671 | A1 | 11/2001 |
| WO | WO-2004/041007 | A2 | 5/2004 |

OTHER PUBLICATIONS

International Search Report and Written Opinion dated Nov. 5, 2007 for PCT/IB2007/001770.

* cited by examiner

GAMMA CYCLODEXTRIN FLAVORING-RELEASE ADDITIVES

CROSS-REFERENCE TO RELATED APPLICATIONS

This application is a continuation under 35 U.S.C. § 120 of U.S. application Ser. No. 15/583,462, filed May 1, 2017, which is a continuation under 35 U.S.C. § 120 of U.S. application Ser. No. 14/519,792, filed Oct. 21, 2014 (now U.S. Pat. No. 9,668,519), which is a continuation under 35 U.S.C. § 120 of U.S. application Ser. No. 12/791,614, filed Jun. 1, 2010 (now U.S. Pat. No. 8,864,909), which is a continuation under 35 U.S.C. § 120 of U.S. application Ser. No. 11/702,617, filed Feb. 6, 2007 (now abandoned), which claims priority under 35 U.S.C. § 119(e) to U.S. Provisional No. 60/771,462, filed Feb. 9, 2006, the entire contents of each of which are incorporated herein by reference.

BACKGROUND

Traditional cigarettes are smoked by lighting an end of a wrapped tobacco rod and drawing air predominately through the lit end by suction at a mouthpiece end of the cigarette. Traditional cigarettes deliver smoke as a result of combustion, during which tobacco is combusted at temperatures that typically exceed 800° C. during a puff. The heat of combustion releases various gaseous combustion products and distillates from the tobacco. As these gaseous products are drawn through the cigarette, they cool and condense to form an aerosol, which provides the flavors and aromas associated with smoking.

An alternative to the more traditional cigarette is an electrically heated cigarette used in electrical smoking systems. As compared to traditional cigarettes, electrical smoking systems significantly reduce sidestream smoke, and also permit smokers to suspend and reinitiate smoking as desired. Exemplary electrical smoking systems are disclosed in commonly-owned U.S. Pat. Nos. 6,026,820; 5,988,176; 5,915,387; 5,692,526; 5,692,525; 5,666,976; 5,499,636; and 5,388,594, each of which is hereby incorporated by reference in its entirety.

Electrical smoking systems include an electrically powered lighter and an electrically heated cigarette, which is constructed to cooperate with the lighter. It is desirable that electrical smoking systems be capable of delivering smoke in a manner similar to the smoker's experiences with traditional cigarettes, such as by providing an immediacy response (smoke delivery occurring immediately upon draw), a desired level of delivery (that correlates with FTC tar level), a desired resistance to draw (RTD), as well as puff-to-puff and cigarette-to-cigarette consistency.

Volatile flavorings have been incorporated in traditional cigarettes to add flavors and aromas to mainstream and sidestream tobacco smoke. See, for example, U.S. Pat. Nos. 3,006,347; 3,236,244; 3,344,796; 3,426,011; 3,972,335; 4,715,390; 5,137,034; 5,144,964; and 6,325,859, and commonly-owned International Publication No. WO 01/80671. The added flavorings are desirably volatilized when the cigarette is smoked. However, volatile flavorings tend to migrate in the cigarette to other components and possibly through the entire cigarette.

Volatile flavorings can be lost from cigarettes during storage and distribution at ordinary conditions prior to smoking of the cigarettes. The degree of migration of volatile flavorings in cigarettes depends on different factors, including the flavorings vapor pressure, the solubility of the flavoring in other components of the cigarette, and temperature and humidity conditions.

Flavorings also can chemically and/or physically deteriorate by contacting and/or reacting with other components of the cigarette, as well as with the environment. For example, activated carbon has been incorporated in cigarettes to remove gas-phase constituents from mainstream smoke. However, flavorings that have been incorporated in the cigarettes along with the activated carbon can be adsorbed by the activated carbon, which can clog pores of the activated carbon and consequently deactivate the activated carbon, thereby diminishing its ability to filter tobacco smoke.

For the foregoing reasons, flavorings that have been incorporated in cigarettes have not been totally satisfactorily delivered to the smoker. Due to the flavoring loss, the uniformity of flavored cigarettes has not been totally satisfactory. In addition, the sorption of flavorings by sorbents in the cigarettes can deactivate the sorbents and thereby reduce the sorbent's ability to remove gas phase constituents from tobacco smoke.

SUMMARY

In view of the above-described problems, a flavoring-release additive including gamma cyclodextrin and flavoring is provided. By providing flavoring within gamma cyclodextrin, the flavoring can be protected from loss during storage and distribution, and the flavoring can be released through thermal degradation upon heating of the gamma cyclodextrin.

In an exemplary embodiment, an electrically heated cigarette for an electrical smoking system, comprises at least one sorbent; and a flavoring-release additive comprising gamma cyclodextrin and at least one flavoring is provided.

In another exemplary embodiment, a method of making an electrically heated cigarette, comprising incorporating into an electrically heated cigarette (a) the at least one sorbent, and (b) the flavoring-release additive comprising gamma cyclodextrin and at least one flavoring is provided.

DETAILED DESCRIPTION

Figure 1:
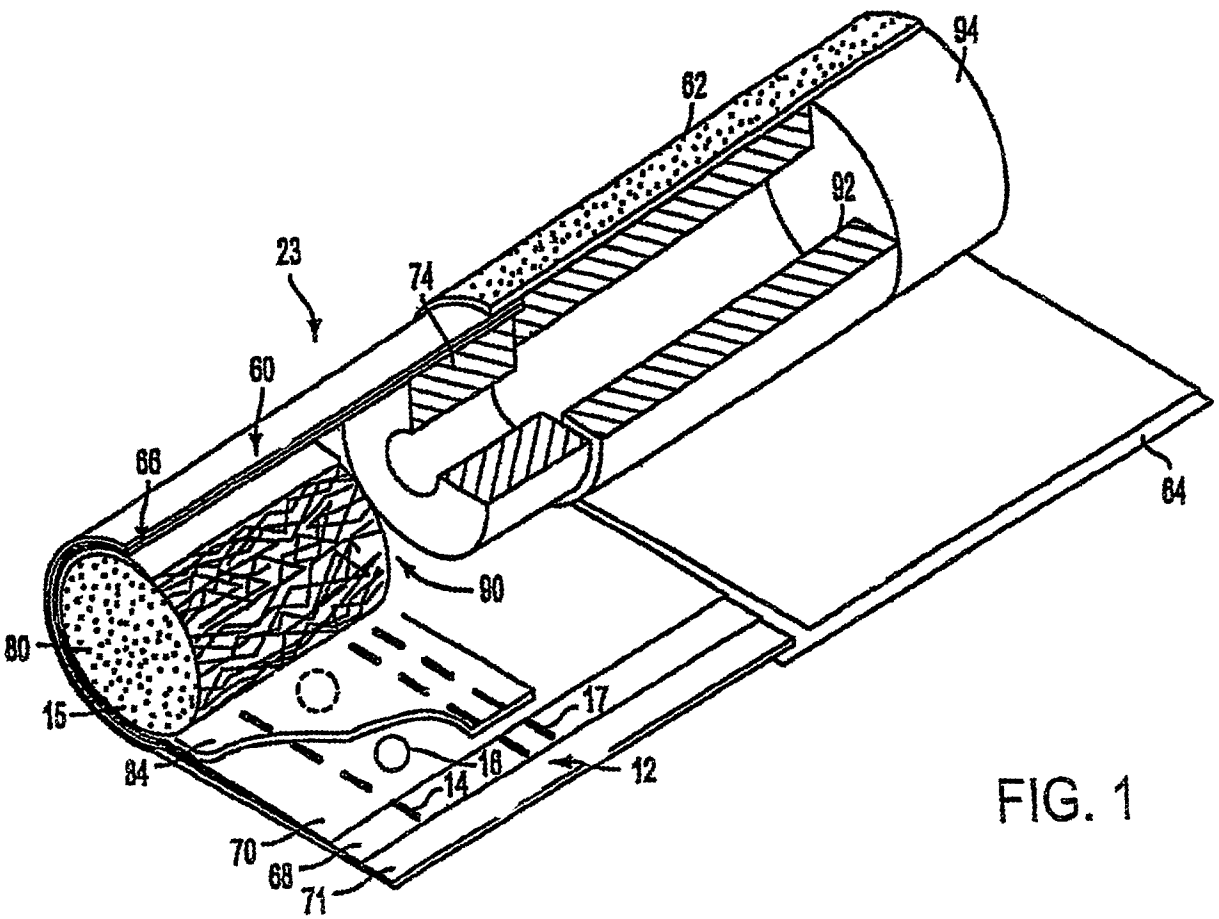
FIG. 1 illustrates an exemplary embodiment of an electrically heated cigarette for use in an electrical smoking system with the cigarette in a partially unassembled condition.

Gamma cyclodextrins, as used herein, are provided with flavoring to protect the flavoring from exposure to the atmosphere (e.g., ambient air, inside a package) and cigarette components (e.g., sorbents). The gamma cyclodextrin can reduce migration of flavoring in a cigarette prior to smoking. In addition, the flavoring can be thermally released from the gamma cyclodextrin flavoring-release additive in the cigarette in a controlled manner during smoking. Consequently, through inclusion of a flavoring guest molecule within a gamma cyclodextrin inclusion complex host molecule, the flavoring can be substantially prevented from migrating in the cigarette, reacting with other substances in the cigarette or with the environment, and deactivating sorbent present in the cigarette.

Cyclodextrins are cyclic oligosaccharides including glucopyranose subunits, as described, for example, in U.S. Pat. No. 3,426,011 and commonly-owned U.S. Pat. No. 5,144,964, which are incorporated herein by reference in their entirety. Alpha-cyclodextrin, beta-cyclodextrin and gamma cyclodextrin include six, seven, and eight glucopyranose subunits, respectively.

As discussed herein, a gamma cyclodextrin flavoring-release additive comprises a gamma cyclodextrin and at least one flavoring. The gamma cyclodextrin comprises a gamma cyclodextrin inclusion complex "host molecule," and a flavoring "guest molecule." In an exemplary embodiment, the flavoring is a lipophilic organic flavoring, which can be held within the inclusion hydrophobic cavity or hole in the gamma cyclodextrin formed by the eight glucopyranose subunits.

In commonly-owned U.S. Patent Publication No. 2004/0129280 to Woodson et al. (hereinafter "Woodson") and commonly-owned U.S. Patent Publication No. 2005/0172976 to Newman et al. (hereinafter "Newman"), which are incorporated herein in their entireties for all purposes, Woodson and Newman disclose electrically heated cigarettes which can include beta cyclodextrin and flavoring. While the use of beta cyclodextrin can protect flavorings, such as menthol, the beta cyclodextrin only delivers low levels of the flavoring (i.e., 10% delivery compared to a control menthol cigarette).

Unexpectedly, however, gamma cyclodextrin can deliver disproportionately higher flavoring levels than beta cyclodextrin when flavoring is provided in equal amounts to equal amounts of gamma cyclodextrin and beta cyclodextrin. While not wishing to be bound by theory, it is believed that gamma cyclodextrin with its additional glucopyranose subunit creates a larger ring and therefore has a larger inclusion hydrophobic cavity or "hole" than an alpha or beta cyclodextrin. This larger hole, it is believed, allows gamma cyclodextrin to hold more flavoring within the ring (i.e., more of the flavoring is loaded into gamma cyclodextrin rings upon saturation, than is loaded into beta cyclodextrin rings upon saturation of the rings). Thus, it is believed that it is because of the additional glucopyronose subunit that gamma cyclodextrin can deliver higher levels of flavoring than the beta cyclodextrin. This is illustrated in the Example below.

Figure 7:
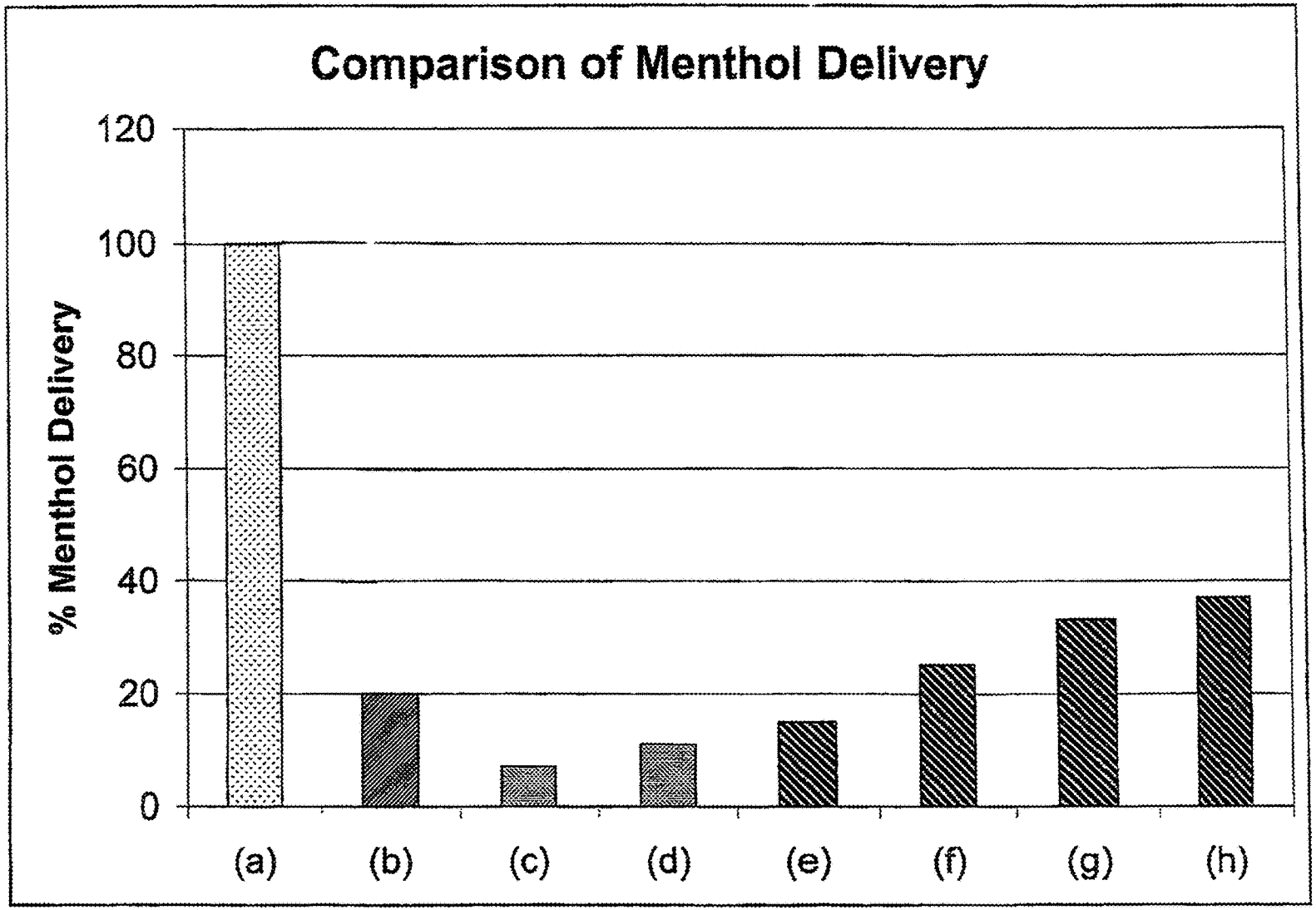
FIG. 7, FIG. 8, and FIG. 9 illustrate exemplary flavoring release comparisons for different flavoring delivery encapsulants.
Figure 8:
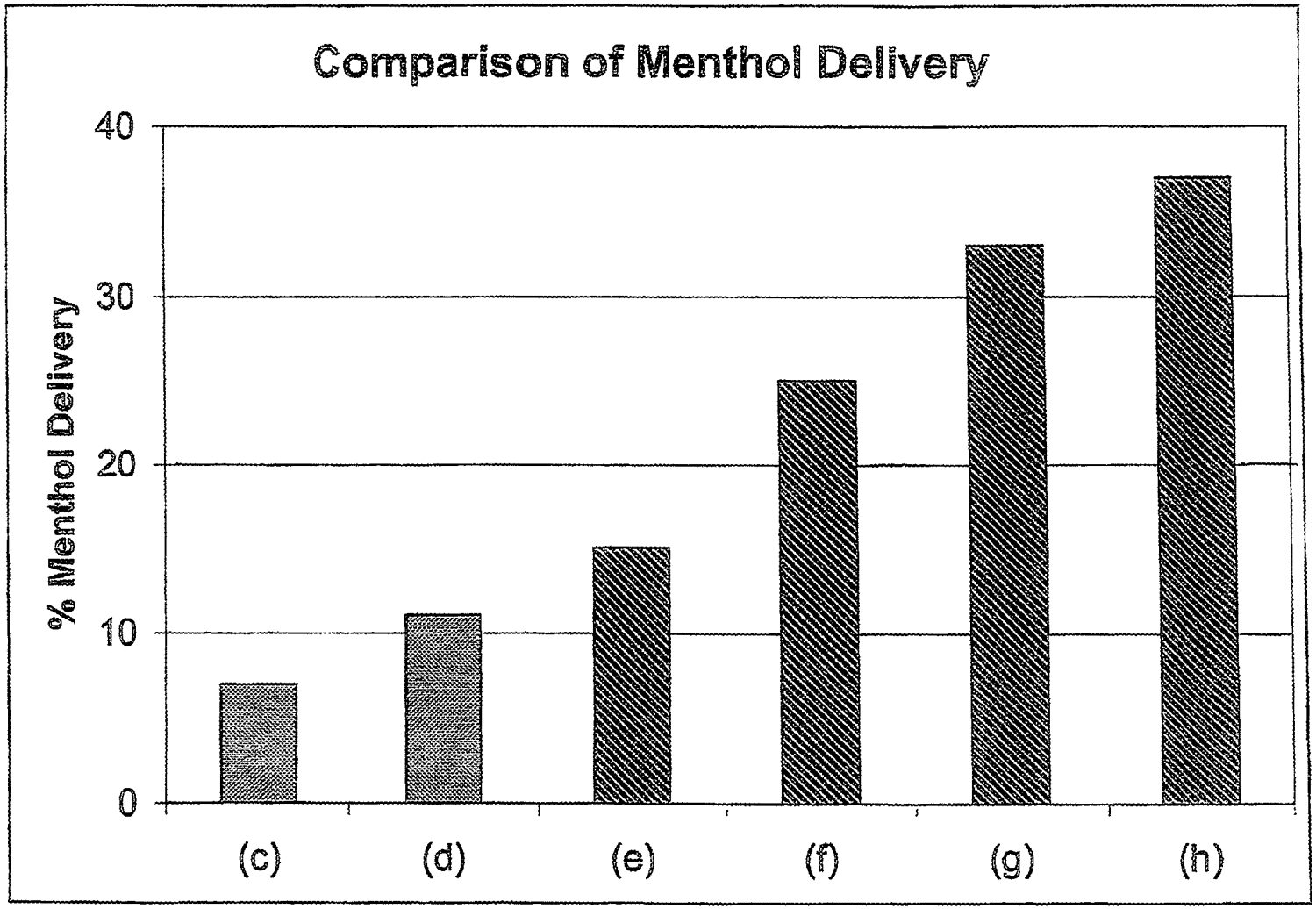

In this Example, the effectiveness of gamma cyclodextrin in flavoring-release additives is compared to other flavoring-release additives. For comparison purposes, the flavoring used is menthol, wherein the menthol deliveries compared are menthol containing cigarettes, which include:

1) electrically heated cigarettes with gamma cyclodextrin with menthol flavoring from 20 wt. % to 33 wt. % (Samples (e), (f), (g) and (h) from FIGS. 7 and 8);
2) electrically heated cigarettes with beta-cyclodextrin with 23 to 33 wt. % (Samples (c) and (d) from FIGS. 7 and 8);
3) electrically heated cigarettes with menthol containing microcapsules (Sample (b) from FIGS. 7); and
4) control lit-end, or traditional menthol cigarettes (Sample (a) from FIG. 7) (i.e., non-sorbent containing traditional cigarettes with menthol diffused into the cigarette).

The menthol containing cigarettes listed above, are compared below in Table 1.

It is noted that as used herein, the beta and gamma cyclodextrin materials can be commercially purchased, for example, from Cargill, Inc. of Cedar Rapids, Iowa, then combined with flavorant to form flavoring containing electrically heated cigarettes. Additionally, the microcapsules can be commercially purchased, for example, from V Mane Fils S A, Le Bar Sur Loup, France, and then inserted into a cavity of an electrically heated cigarette. Also, the control menthol traditional lit end cigarettes can be commercially purchased, for example, as MARLBORO Menthol Lights cigarettes from Philip Morris USA of Richmond, Virginia.

The beta and gamma cyclodextrin/menthol inclusion complexes can be formed according to the compositions listed in Table 1 by:

1) dissolving the cyclodextrin in water to form a cyclodextrin aqueous solution;
2) mixing menthol and ethanol to form a menthol mixture;
3) mixing the cyclodextrin aqueous solution with the menthol mixture to form a clear solution;
4) sonicating the clear solution for about 1 to about 15 minutes in order to precipitate cyclodextrin flavoring-release additives therefrom; and
5) spray drying the precipitated cyclodextrin flavoring-release additives at 200° C. or less under high vacuum to remove the water.

TABLE 1

Samples of Cyclodextrin (CD)/menthol inclusion complexes

| FIG. 7 | CD type(s) | Loading % | Inclusion Complex System |
|---|---|---|---|
| (c) | β-CD | 20 | 40 g β-CD/12 g menthol/20 g ethanol/100 g water |
| (d) | β-CD | 33 | 40 g β-CD/20 g menthol/20 g ethanol/100 g water |
| (e) | γ-CD | 20 | 40 g γ-CD/10 g menthol/20 g ethanol/150 g water |
| (f) | γ-CD | 23 | 40 g γ-CD/12 g menthol/20 g ethanol/150 g water |
| (g) | γ-CD | 30 | 40 g γ-CD/17 g menthol/20 g ethanol/100 g water |
| (h) | γ-CD | 33 | 80 g γ-CD/40 g menthol/40 g ethanol/200 g water |

The loading % is based upon the amount of menthol included in the inclusion complex system. After loading the inclusion complex systems, the inclusion complexes can be incorporated into tobacco of electrically heated cigarettes, i.e., the mats of the electrically heated cigarettes. The delivery of menthol can then be calculated by the amount of menthol released from the inclusion complexes that is delivered, i.e., the amount released that is not adsorbed by sorbent downstream from the tobacco portion of the cigarette.

Figure 9:
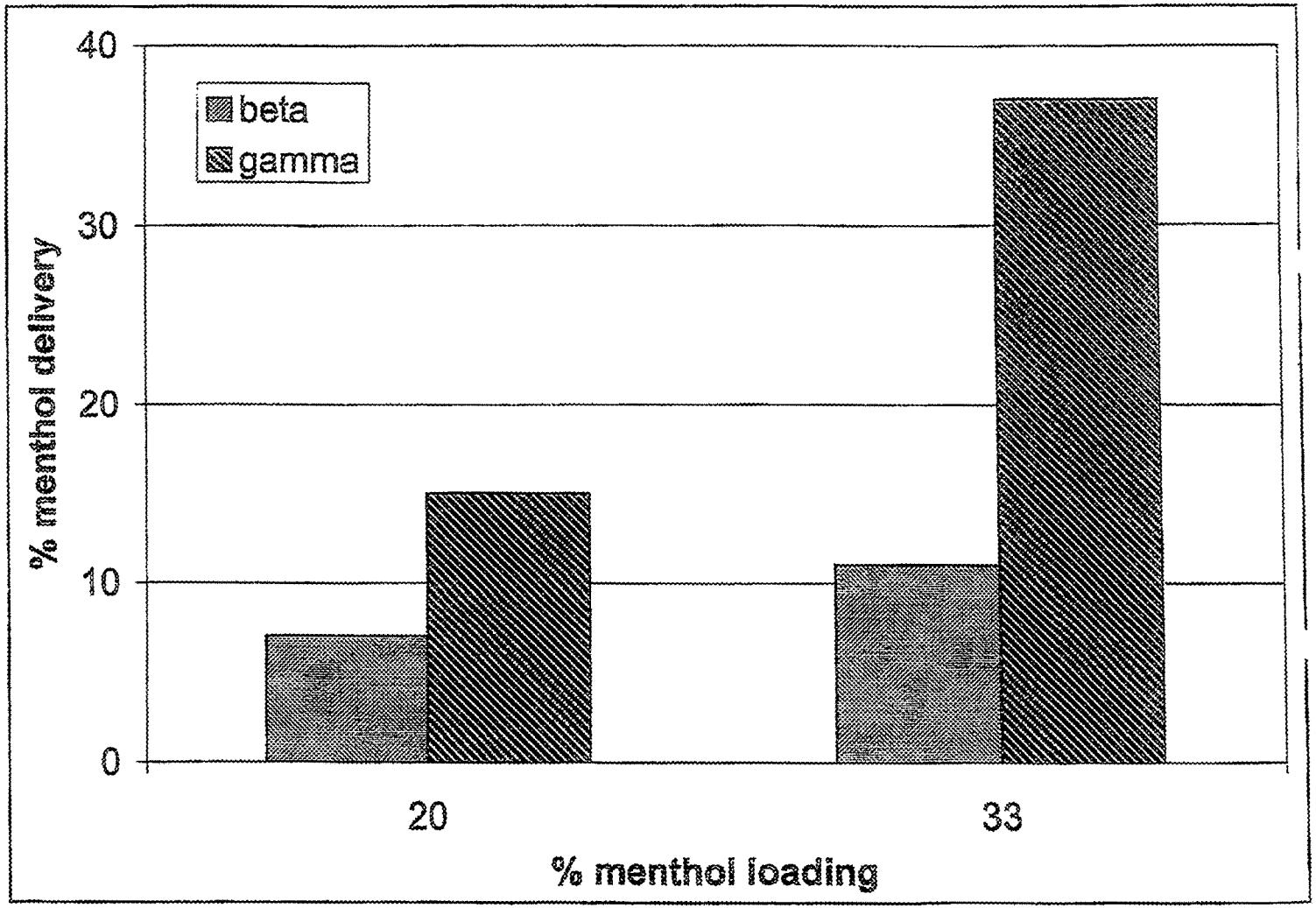

The four types of menthol containing cigarettes (including those from the above preparations) are compared in FIGS. 7-9. It is noted that the "menthol delivery" illustrated in FIGS. 7-9 is the delivery amount of menthol (downstream from any sorbents) by each of the menthol containing cigarette based upon a maximum or 100% menthol delivery defined as the amount of menthol that can be delivered to a smoker from the control traditional lit end menthol cigarette (sample (a) in FIG. 7). In other words, the % menthol delivery is the amount of menthol delivered by one of the four types of menthol containing cigarette (i.e., the electrically heated beta cyclodextrin-menthol cigarette, the electrically heated gamma cyclodextrin-menthol cigarette, the electrically heated microcapsule menthol cigarette or the control traditional lit end menthol cigarette) divided by the amount of menthol delivered by a control traditional lit end menthol cigarette.

In this example, 20% menthol delivery corresponds to a delivery of about 0.0125 mg of menthol per puff (with eight puffs per cigarette) or at least about 0.1 mg of menthol per cigarette (compared to about 0.5 mg of menthol per control traditional lit end menthol cigarette). However, it is noted that menthol amounts of at least 0.02 mg of menthol per puff or at least about 0.15 mg of menthol per cigarette (i.e., at least about 30% menthol delivery) can give a more desirable taste.

In FIGS. 7-9, as mentioned above, the "menthol delivery" or "% menthol delivery" is calculated based upon the amount of menthol per cigarette delivered (after any sorption by sorbents) to a smoker of each of the menthol containing cigarettes divided by the amount of menthol per cigarette delivered to a smoker from the control menthol traditional lit end cigarette to provide the % menthol delivery. In other words, 20% menthol delivery by an electrically heated gamma cyclodextrin-menthol cigarette can be delivered if the control menthol traditional lit end cigarette delivers 0.1 gram of menthol and the electrically heated gamma cyclodextrin-menthol cigarette delivers 0.02 grams.

Also, the amount of "menthol loading" or the "% menthol loading" is calculated based upon the total amount of additive when initially mixed. In other words, as shown in Table 1, sample (c), 20% menthol loading can be formed by loading 12 grams of menthol into 40 grams of beta cyclodextrin and 20 grams of ethanol (i.e., 12 g menthol/(40 g β-CD+20 g ethanol)=20% menthol loading), wherein water can also be added in varying amount. It is noted that the % listed herein are each on a weight basis (and not an atomic basis). In other words, 20% menthol loading is intended to indicate 20% menthol loading by weight.

In FIG. 8, which is an enlarged view of samples (c)-(h), along with FIG. 9, which is a comparison of beta cyclodextrin and gamma cyclodextrin loading levels compared with delivery levels, the % menthol delivery of the beta cyclodextrin compared to the % menthol delivery of the gamma cyclodextrin is illustrated.

As shown in FIGS. 7-9, beta cyclodextrin provides low levels of menthol delivery even with higher loading levels as compared to any of the other samples. For example, the beta cyclodextrin samples with 20% menthol loading (sample (c) in FIGS. 7-9 and Table 1 with 40 grams beta cyclodextrin, 12 g menthol, 20 g ethanol and 100 g water) and 33% menthol loading (sample (d) in FIGS. 7-9 and Table 1) provide only about 7% menthol delivery and 11% menthol delivery, respectively. Additionally, as shown in FIGS. 7-9, gamma cyclodextrin with 20% menthol loading (sample (e) in FIG. 7 and Table 1) provided only about 15% menthol delivery.

Unexpectedly, however, as illustrated in FIGS. 7-9, menthol loading greater than 20% in gamma cyclodextrin delivers a disproportionate increase in % menthol delivery compared to the increase in % menthol loading. One would expect, based upon the change in % menthol delivery from the 20% menthol loaded beta cyclodextrin to the 30% menthol loaded beta cyclodextrin, that the % menthol delivery would increase approximately proportionally (see FIG. 9 comparing the beta cyclodextrin at 20% menthol loading and 30% menthol loading).

For example, 20% menthol loading in a beta cyclodextrin provides only about 7% menthol delivery, and 33% menthol loading provides only about 11% menthol delivery. However, the change in % menthol delivery from the 20% menthol loaded gamma cyclodextrin to the 30% menthol loaded gamma cyclodextrin, showed a marked increase in % menthol delivery.

As shown in FIGS. 7 and 8 while a 20% menthol loading in gamma cyclodextrin leads to 15% menthol delivery, 23% menthol loading in gamma cyclodextrin (sample (f) in FIG. 7 and Table 1) leads to about 25% menthol delivery. Additionally, as illustrated in FIG. 9, again, 20% menthol loading in gamma cyclodextrin leads to 15% menthol delivery, however, 33% menthol loading in gamma cyclodextrin leads to about 37% menthol delivery.

Additionally, menthol loading over 20% in gamma cyclodextrin, unlike menthol loading in beta cyclodextrin or at 20%, can result in more than 15% or even 20% menthol delivery, as desired. As shown in FIGS. 7 and 8, 23% menthol loading in gamma cyclodextrin (sample (f) in FIG. 7 and Table 1) leads to about 25% menthol delivery. When compared to the 20% and 33% menthol loading in beta cyclodextrin, each of which results in 15% or less menthol delivery, the results of the % menthol delivery by the gamma cyclodextrin are unexpected.

Also, as shown in FIGS. 7 and 8, the increase in menthol delivery over 20% is disproportionate to the increase in % menthol loading. For example, as shown in FIGS. 7 and 8, by increasing the menthol loading by 3% to provide a 23% menthol loading in gamma cyclodextrin 10% more menthol can be delivered for gamma cyclodextrin. This is unexpected especially because such change is not noticed in the beta cyclodextrin. For example, 13% more menthol loading in beta cyclodextrin only provides a 4% increase in menthol delivery.

These unexpected results are further emphasized by the sample with 30% menthol loading into gamma cyclodextrin (sample (g) in FIG. 7 and Table 1), which results in about 34% menthol delivery. As shown by this sample, a 7% increase in menthol loading results in a 9% increase in menthol delivery. Similarly, as also shown in FIGS. 7-9, about 33% menthol loading (sample (h) in FIG. 7 and Table 1) results in about 37% menthol delivery.

As a result, by using gamma cyclodextrin with 23% or higher menthol loading, 25% or higher menthol delivery can be achieved. This is unexpected in view of the lower menthol delivery that can be achieved using the beta cyclodextrin and lower menthol loading levels. This is illustrated in FIG. 9, which compares equal loading levels of menthol in beta cyclodextrin and gamma cyclodextrin, wherein the gamma cyclodextrin has a much higher delivery for both 20% and 33% loading, but the 33% loading has a much larger difference between the beta cyclodextrin and the gamma cyclodextrin in % menthol delivery.

A gamma cyclodextrin flavoring-release additive can be manufactured by any suitable process that produces additives having the desired structure, composition, and size, wherein the gamma cyclodextrin flavoring-release additive is preferably water-soluble. One way to manufacture a gamma cyclodextrin flavoring-release additive includes co-precipitating, filtering and drying a mixture of gamma cyclodextrin and at least one flavoring. For example, gamma cyclodextrin flavoring-release additive can be formed by mixing flavoring with gamma cyclodextrin in an aqueous solution, wherein this mixing can cause the flavoring to be incorporated as a guest molecule inside the host gamma cyclodextrin ring structure. Next, a powder of gamma cyclodextrin flavoring-release additive can be recovered from the solution by precipitating the powder particles out of the mixture, wherein the powder particles can be spray dried to remove the water. Alternatively, the gamma cyclodextrin flavoring release additive can be formed by extrusion, spray drying, coating, or other suitable processes of incorporating flavoring as a guest molecule inside a host gamma cyclodextrin ring structure.

In exemplary embodiments, gamma cyclodextrin flavoring-release additives can be provided in smoking articles in forms including, but not limited to powders, films, solutions and/or suspensions. For example, gamma cyclodextrin flavoring-release additive can include powder or particles sized from 60 to 400 mesh. It is noted that the gamma cyclodextrin flavoring-release additive can be provided as a powder with a maximum particle size of less than about 200 microns, and more preferably less than about 1 micron and a minimum particle size of about 1 nm, preferably more than about 10 nm. Decreasing the size of the powder can provide a more homogenous and controlled release of flavoring by providing increased surface area of the powder.

As another example, the gamma cyclodextrin flavoring-release additive can be provided in a tobacco mat for an electrically heated cigarette. For example, a tobacco mat can be formed by mixing gamma cyclodextrin flavoring-release additive powder with tobacco dust in a slurry mixture to form a tobacco mat.

Alternatively, a gamma cyclodextrin flavoring-release additive film can be coated onto a tobacco mat for an electrically heated cigarette. For example, gamma cyclodextrin flavoring-release additive can be mixed with water and film forming agent, such as propylene glycol, then coated onto a tobacco mat. Exemplary processes that can be used to prepare the films are described in U.S. Pat. No. 3,006,347 and commonly-owned U.S. Pat. No. 4,715,390, each of which is incorporated herein by reference in their entirety.

The dimensions of a gamma cyclodextrin flavoring-release additive film are not limited. Preferably, the film has a thickness of up to about 150 microns or about 50 microns to about 150 microns, and more preferably up to about 75 microns. In another exemplary embodiment, a film of gamma cyclodextrin flavoring-release additive can be preformed, shredded and incorporated in the tobacco plug, and/or other selected locations that reach the flavoring release temperature. Exemplary processes that can be used to apply the gamma cyclodextrin flavoring-release additive in an electrically heated cigarette are also described in commonly-owned U.S. Pat. No. 5,144,964, which is incorporated herein by reference in its entirety.

The gamma cyclodextrin flavoring-release additive can also be used in a solution or a suspension. If the gamma cyclodextrin flavoring-release additive is provided in a solution or a suspension, the solution or suspension can be applied directly to one or more selected locations of one or more components of an electrically heated cigarette by any suitable process. For example, a solution of gamma cyclodextrin flavoring-release additive can be applied to a tobacco mat by a coating process, such as slurry coating, spraying, a dipping process, electrostatic deposition, printing wheel application, gravure printing, ink jet application, and the like.

In an exemplary embodiment, gamma cyclodextrin flavoring-release additives can be disposed in at least one location in the electrically heated cigarette that reaches at least the minimum temperature at which the flavoring is released from the gamma cyclodextrin in the cigarette during smoking. For example, the gamma cyclodextrin flavoring-release additive can be disposed on an inner wrap, a tobacco mat, and/or an over wrap in the electrically heated cigarette. For example, the gamma cyclodextrin flavoring-release additive can be sprinkled on or adhered (with an adhesive) to the inner wrap, the tobacco mat and/or the over wrap.

Exemplary electrically heated cigarettes 23 include sufficient levels of flavoring and/or gamma cyclodextrin flavoring-release additive to provide a desired amount of the flavoring in the cigarettes. The cigarette can comprise, for example, from about 1 mg to about 30 mg of flavoring and/or about 1 mg to about 50 mg of gamma cyclodextrin flavoring-release additive.

The amount of gamma cyclodextrin flavoring-release additive in a cigarette can be based upon the weight of a cigarette or the weight of components in the cigarette. For example, an electrically heated cigarette can be, based on the total weight of tobacco in the tobacco mat and/or tobacco plug of the electrically heated cigarette, up to about 20%, and more preferably about 10% to about 15% gamma cyclodextrin flavoring-release additive. In other words, a cigarette containing 100 mg of tobacco preferably contains up to about 20 mg of gamma cyclodextrin flavoring-release additive.

Alternatively, the amount of gamma cyclodextrin flavoring-release additive in an exemplary embodiment, can include, based on the weight of the inner wrap, the tobacco mat and/or the over wrap, up to about 15%, and more preferably less than about 8%, of the gamma cyclodextrin flavoring-release additive. In other words, for a cigarette with a 10 mg tobacco mat, 1.5 mg of gamma cyclodextrin flavoring-release additive can be provided.

Gamma cyclodextrin flavoring-release additive can release flavoring at temperatures of at least about 200° C., such as about 200° C. to about 400° C. While not wishing to be bound by theory, it is believed that at temperatures of at least about 200° C., the ring of glucopyranose subunits of the gamma cyclodextrin opens and thus releases a flavoring guest molecule from the gamma cyclodextrin host molecule. It is also believed that at temperatures above about 400° C., the gamma cyclodextrin begins to decompose, thus causing flavoring release to be less uniform and less controlled.

In an exemplary embodiment, the gamma cyclodextrin flavoring-release additive is disposed in at least one location in the electrically heated cigarette that reaches at least the flavoring release temperature. For example, the gamma cyclodextrin flavoring-release additive can be disposed on an inner wrap, a tobacco mat and/or an outer wrap such that the gamma cyclodextrin flavoring-release additive can be heated by a heater element when the inner wrap, the tobacco mat and/or the outer wrap is heated.

The gamma cyclodextrin flavoring-release additive can further include an optional encapsulating material to provide additional barrier properties. The encapsulating material can include a binder, which can include, but is not limited to, one or more of carrageenan, gelatin, agar, gellan gum, gum arabic, guar gum, xanthum gum, and pectin. Other materials known in the art that can improve characteristics of an encapsulating material, e.g., film forming characteristics or additive stability, can optionally be added.

Suitable flavorings include, but are not limited to, menthol, mint, such as peppermint and spearmint, chocolate, licorice, citrus and other fruit flavors, gamma octalactone, vanillin, ethyl vanillin, breath freshener flavors, spice flavors, such as cinnamon, methyl salicylate, linalool, bergamot oil, geranium oil, lemon oil, ginger oil, tobacco flavor, and combinations thereof. In an exemplary embodiment, the flavoring includes menthol or vanillin.

In exemplary embodiments, one or more sorbents capable of sorption or removal of selected gas-phase constituents from mainstream smoke are provided within a filter portion of an electrically heated cigarette. As used herein, the term "sorption" denotes adsorption and/or absorption. Sorption is intended to encompass interactions on the outer surface of the sorbent, as well as interactions within the pores and channels of the sorbent. In other words, a "sorbent" is a substance that has the ability to condense or hold molecules of other substances on its surface, and/or has the ability to take up other substances, i.e., through penetration of the other substances into its inner structure, or into its pores. The term "sorbent," as used herein, refers to an adsorbent, an absorbent, or a substance that can function as both an adsorbent and an absorbent.

As used herein, the term "remove" refers to adsorption and/or absorption of at least some portion of a component of mainstream tobacco smoke.

The term "mainstream smoke" includes a mixture of gases passing down the tobacco rod and issuing through the filter end, i.e., the amount of smoke issuing or drawn from the mouth end of a cigarette during smoking of the cigarette. The mainstream smoke contains air that is drawn in through the heated region of the cigarette and through the paper wrapper.

The term "molecular sieve" as used herein refers to a porous structure comprised of an inorganic material and/or organic material. Molecular sieves include natural and synthetic materials. Molecular sieves can remove molecules of certain dimensions, while not removing other molecules with different dimensions (e.g., larger dimensions).

Figure 2:
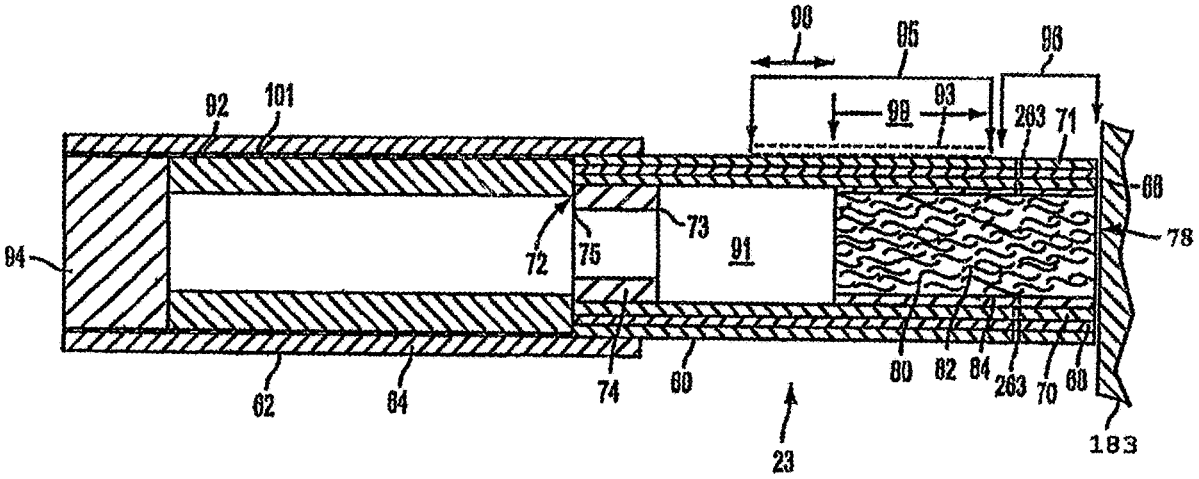
FIG. 2 illustrates the electrically heated cigarette shown in FIG. 1 in the assembled condition with one end of the cigarette contacting a stop piece of an electrically operated lighter of the electrical smoking system.

FIGS. 1 and 2 illustrate an exemplary embodiment of an electrically heated cigarette 23. The electrically heated cigarette 23 comprises a tobacco rod 60 and a filter tipping 62 joined together by tipping paper 64. The tobacco rod 60 can include a tobacco web or a mat 66 folded into a tubular form about a free-flow filter 74 at one end and a tobacco plug 80 at the other end.

An over wrap 71 surrounds the mat 66 and is held together along a longitudinal seam. The over wrap 71 retains the mat 66 in a wrapped condition about the free-flow filter 74 and tobacco plug 80.

The mat 66 can comprise a base web 68 and a layer of tobacco material 70. The tobacco material 70 can be located along an inside surface or an outside surface of the base web 68. At the tipped end of the tobacco rod 60, the mat 66 and the over wrap 71 are wrapped about the free-flow filter plug 74. The tobacco plug 80 can comprise a relatively short tobacco column 82 of cut filler tobacco, which is retained by a surrounding inner wrap 84.

A void 90 is between the free-flow filter 74 and the tobacco plug 80. The void 90 is an unfilled portion of the tobacco rod 60 and is in fluid communication with the tipping 62 through the free-flow filter 74.

The tipping 62 can comprise a free-flow filter 92 located adjacent the tobacco rod 60 and a mouthpiece filter plug 94 at the distal end of the tipping 62 from the tobacco rod 60. The free-flow filter 92 can be tubular and can transmit air with very low pressure drop. The mouthpiece filter plug 94 closes off the free end of the tipping 62.

The cigarette 23 optionally includes at least one row of perforations 12 adjacent the free end 15 of the cigarette 23. The perforations can be formed as slits 17, which can extend through the over wrap 71, the mat 66, and the inner wrap 84.

To further improve delivery, at least one additional row of perforations 14 comprising slits 17 can optionally be formed at a location along the tobacco plug 80. The perforations 12 or 14 may comprise a single row or a dual row of slits 17. The number and extent of the slits 17 can be selected to control the resistance to draw (RTD) along the side walls of the cigarettes 23 and the delivery.

Optional holes 16 provided in the mat 66 are covered by the over wrap 71. The perforations 12, 14 can be used to approximate desired delivery levels for the cigarette 23, with the holes 16 being used to adjust delivery with a lesser effect on the RTD.

The cigarette 23 can have a substantially constant diameter along its length. The diameter of the cigarette 23, like more traditional cigarettes, is preferably between about 7.5 mm to 8.5 mm so that the electrical smoking system 21 provides a smoker with a familiar "mouth feel" during smoking.

The tobacco column 82 can comprise cut filler of a typical blend of tobaccos, such as blends comprising bright, Burley, and Oriental tobaccos together with, optionally, reconstituted tobaccos and other blend components, including traditional cigarette flavors.

The free-flow filter 92 and the mouthpiece filter plug 94 can be joined together as a combined plug with a plug wrap 101. The plug wrap 101 can be a porous, low-weight plug wrap. The combined plug is attached to the tobacco rod 60 by the tipping paper 64.

As described above, the electrically heated cigarette 23 can comprise one or more sorbents that remove gas-phase constituents of tobacco smoke. The sorbent can comprise one or more porous materials through which tobacco smoke can flow. In an exemplary embodiment, the sorbent is activated carbon. For example, the sorbent can comprise activated carbon granules located in a void in the filter, or activated carbon particles loaded on fibrous material or paper. The activated carbon can be in various forms including particles, fibers, beads, and the like. The activated carbon can have different porosity characteristics, such as a selected pore size and total pore volume.

In another exemplary embodiment, the sorbent is one or more suitable molecular sieve sorbent materials. Microporous, mesoporous, and/or macroporous molecular sieves may be used in the electrically heated cigarette 23, depending on the selected component(s) desired to be removed from mainstream tobacco smoke. Molecular sieve sorbents that may be used in the electrically heated cigarette 23 include, but are not limited to, one or more of the zeolites, mesoporous silicates, aluminophosphates, mesoporous aluminosilicates, and other related porous materials, such as mixed oxide gels, which may optionally further comprise inorganic or organic ions and/or metals. See, for example, commonly-owned International Publication No. WO 01/80973, which is incorporated herein by reference in its entirety.

In an exemplary embodiment, the sorbent is one or more zeolites. Zeolites include crystalline aluminosilicates having pores, such as channels and/or cavities of uniform, molecular sized dimensions. There are many known unique zeolite structures having different sized and shaped pores, which can significantly affect the properties of these materials with regard to sorption and separation processes. Molecules can be separated by zeolites by size and shape effects related to the possible orientation of the molecules in the pores, and/or by differences in strength of sorption. One or more zeolites having pores larger than one or more selected gas phase components of a gas that is desired to be filtered can be used in the electrically heated cigarette 23, such that only selected molecules that are small enough to pass through the pores of the molecular sieve material are able to enter the cavities and be sorbed on the zeolite.

The zeolite can be, but is not limited to, one or more of zeolite A; zeolite X; zeolite Y; zeolite K-G; zeolite ZK-5; zeolite BETA; zeolite ZK-4 and zeolite ZSM-5. In an exemplary embodiment, zeolite ZSM-5 and/or zeolite BETA is used. Zeolite ZSM-5 is in the MFI structural classification family and represented by the crystal chemical data [$Na_n(Al_nSi_{96-n}O_{192})$~$16H_2O$, with n<27, orthorhombic, Pnma], while zeolite BETA is in the BEA structural classification family and represented by the crystal chemical data [$Na_7(Al_7Si_{57}O_{128})$ tetragonal, $P4_122$]. These two zeolites are thermally stable at temperatures up to about 800 EC allowing them to be incorporated in cigarette filters and/or the tobacco rod of the electrically heated cigarette 23.

In another exemplary embodiment, the sorbent incorporated in the electrically heated cigarette 23 has a composite composition. In such embodiment, the sorbent comprises, for example, activated carbon and one or more molecular sieve materials. For example, sorbent fibers can be impregnated with activated carbon and zeolite.

The sorbent can be incorporated in one or more locations of the electrically heated cigarette 23. For example, the sorbent can placed in the passageway of the tubular free-flow filter 74, in the free-flow filter 92, and/or in the void space 90. The sorbent can additionally or alternatively be incorporated in the tobacco plug 80.

Figure 3:
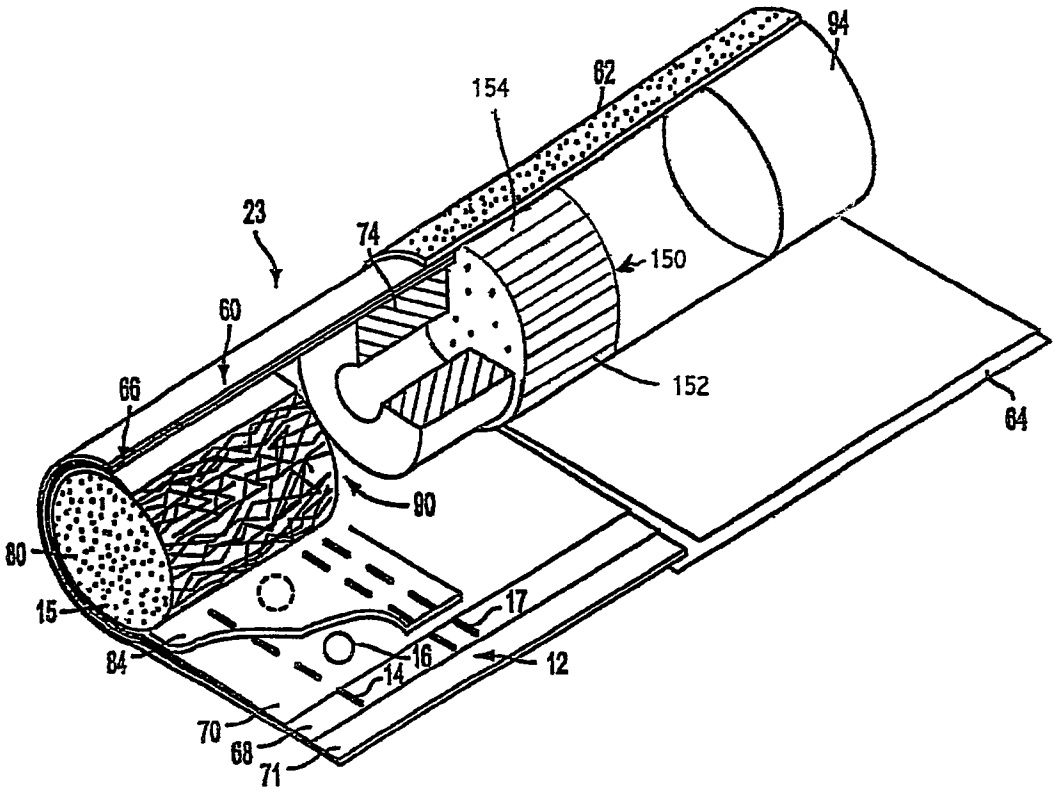
FIG. 3 illustrates another exemplary embodiment of an electrically heated cigarette for use in an electrical smoking system with the cigarette in a partially unassembled condition.

FIG. 3 shows another exemplary embodiment of an electrically heated cigarette 23 including a filter 150. The filter 150 comprises a sorbent in the form of oriented fibers 152 and a sleeve 154, such as paper, surrounding the fibers. The sorbent can be, for example, one or more of activated carbon, silica gel, zeolite, and other molecular sieves in fibrous forms. The sorbents can be surface modified materials, for example, surface modified silica gel, such as amino propyl silyl (APS) silica gel. Sorbent mixtures can provide different filtration characteristics to achieve a targeted filtered mainstream smoke composition.

Alternatively, the fibers 152 can comprise one or more sorbent materials, such as carbon, silica, zeolite and the like, impregnated in microcavity fibers, such as TRIADθ microcavity fiber, as disclosed in commonly-owned International Publication No. WO 01/80973. In an exemplary embodiment, the fibers are shaped microcavity fibers impregnated with particles of one or more sorbent materials, or alternatively continuous activated carbon fibers. The fibers preferably have a diameter of from about 10 microns to about 100 microns. The fibers can have a length of from about 10 microns to about 200 microns, for example.

In another exemplary embodiment, the fibers are bundles of non-continuous fibers, which are preferably oriented parallel to the direction of mainstream smoke flow through the electrically heated cigarette.

The filters 150 including fibers 152 can be formed, for example, by stretching a bundle of non-crimped sorbent fiber material, and can have a controlled total and per filament denier through using a pre-formed or in-situ formed sleeve 154 during the filter making process. The formed filter can be sized by cutting to a desired length. For example, the filters can have a length of from about 5 mm to about 30 mm.

The filter 150 including fibers 152 can be incorporated in the electrically heated cigarette at one or more desired locations. Referring also to FIGS. 1 and 2, in an exemplary embodiment, the filter 150 can be substituted for the entire free-flow filter 92. In another exemplary embodiment, the free-flow filter 150 can be substituted for a portion of the free-flow filter 92. The filter 150 can be in contact with (i.e., abut) the free-flow filter 74, positioned between the free-flow filter 74 and the mouthpiece filter plug 94, or in contact with (i.e., abut) the mouthpiece filter plug 94. The filter 150 can have a diameter substantially equal to that of the outer diameter of the free-flow filter 92 to minimize by-pass of smoke during the filtration process.

The fibrous sorbents can have a high loft with a suitable packing density and fiber length such that parallel pathways are created between fibers. Such structure can effectively remove significant amounts of selected gas-phase constituents, such as formaldehyde and/or acrolein, while preferably removing only a minimal amount of particulate matter from the smoke (i.e., not significantly affecting the total particulate matter (TPM) in the gas). By removing selected constituents, a significant reduction of the selected gas-phase constituents can be achieved. A sufficiently low packing density and a sufficiently short fiber length can be used to achieve such filtration performance.

The amount of sorbent used in exemplary embodiments of the electrically heated cigarette 23 depends on the amount of selected gas-phase constituents in the tobacco smoke and the amount of the constituents that is desired to be removed from the tobacco smoke.

Figure 4:
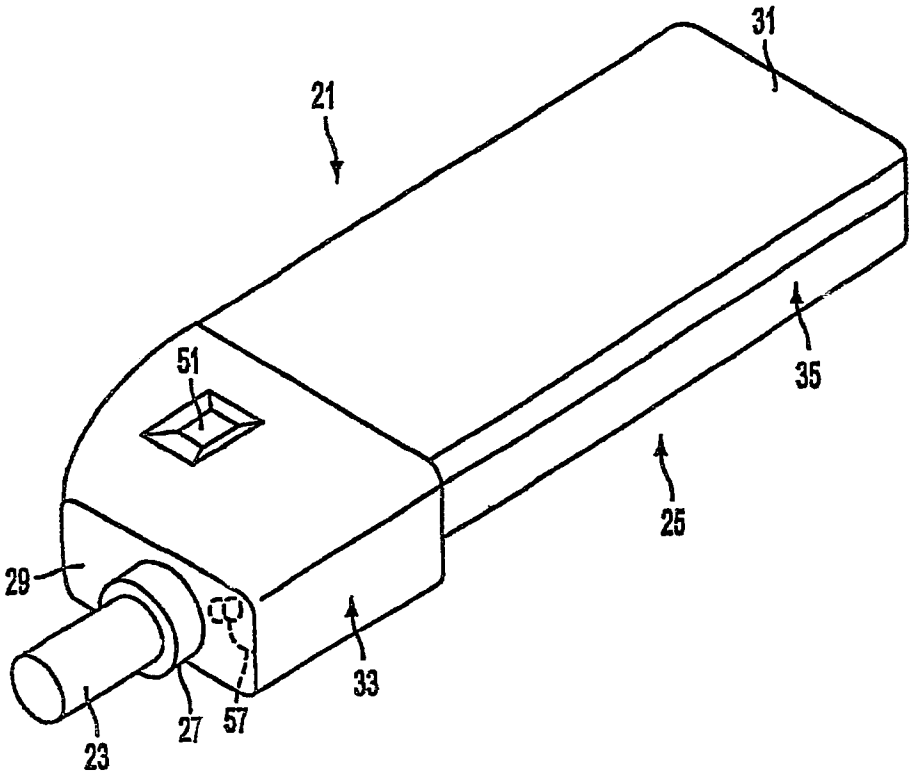
FIG. 4 illustrates an exemplary embodiment of an electrical smoking system with an electrically heated cigarette inserted into the electrically operated lighter.
Figure 5:
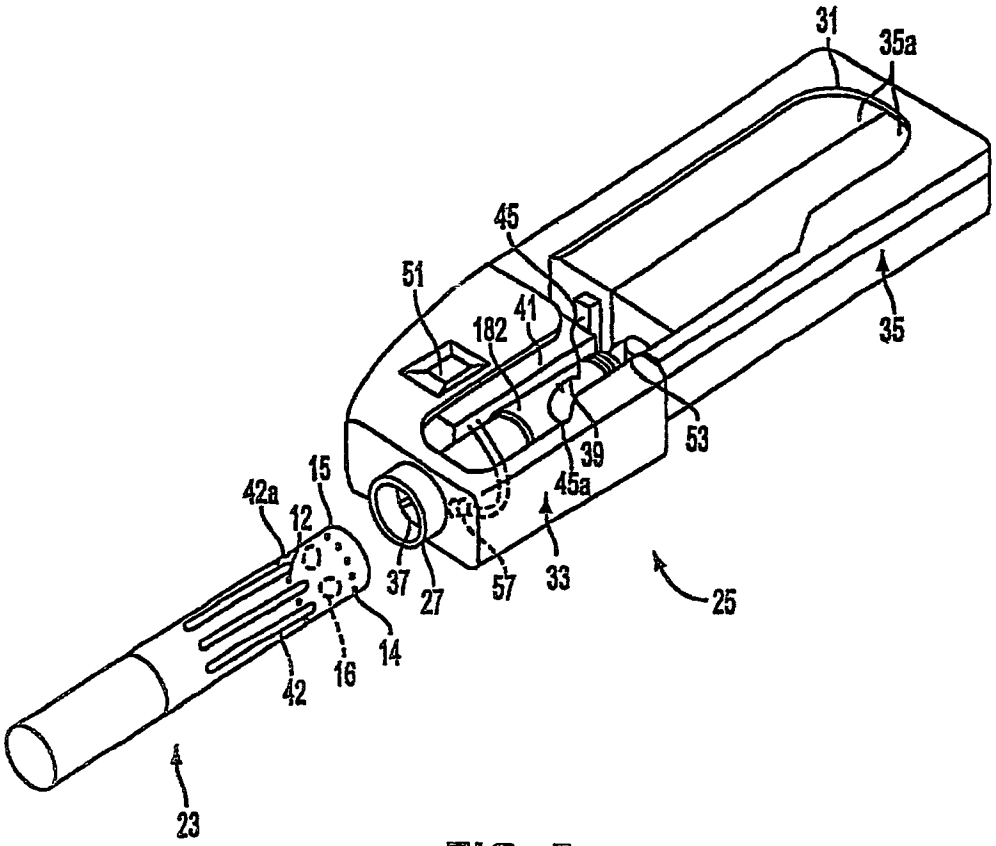
FIG. 5 illustrates the electrical smoking system shown in FIG. 4 with the cigarette withdrawn from the lighter.

FIGS. 4 and 5 illustrate an exemplary embodiment of an electrical smoking system in which exemplary embodiments of the electrically heated cigarette can be used. However, it should be understood that exemplary embodiments of the electrically heated cigarette can be used in electrical smoking systems having other constructions, such as those having different electrically powered lighter constructions. The electrical smoking system 21 includes an electrically heated cigarette 23 and a reusable lighter 25. The cigarette 23 is constructed to be inserted into and removed from a cigarette receiver 27, which is open at a front end portion 29 of the lighter 25. Once the cigarette 23 is inserted, the smoking system 21 is used in a similar manner as a more traditional cigarette, but without lighting or smoldering of the cigarette 23. The cigarette 23 can be discarded after smoking.

Preferably, each cigarette 23 provides a total of at least eight puffs (puff cycles) per smoke. However, the cigarette 23 can be constructed to provide a lesser or greater total number of available puffs.

Figure 6:
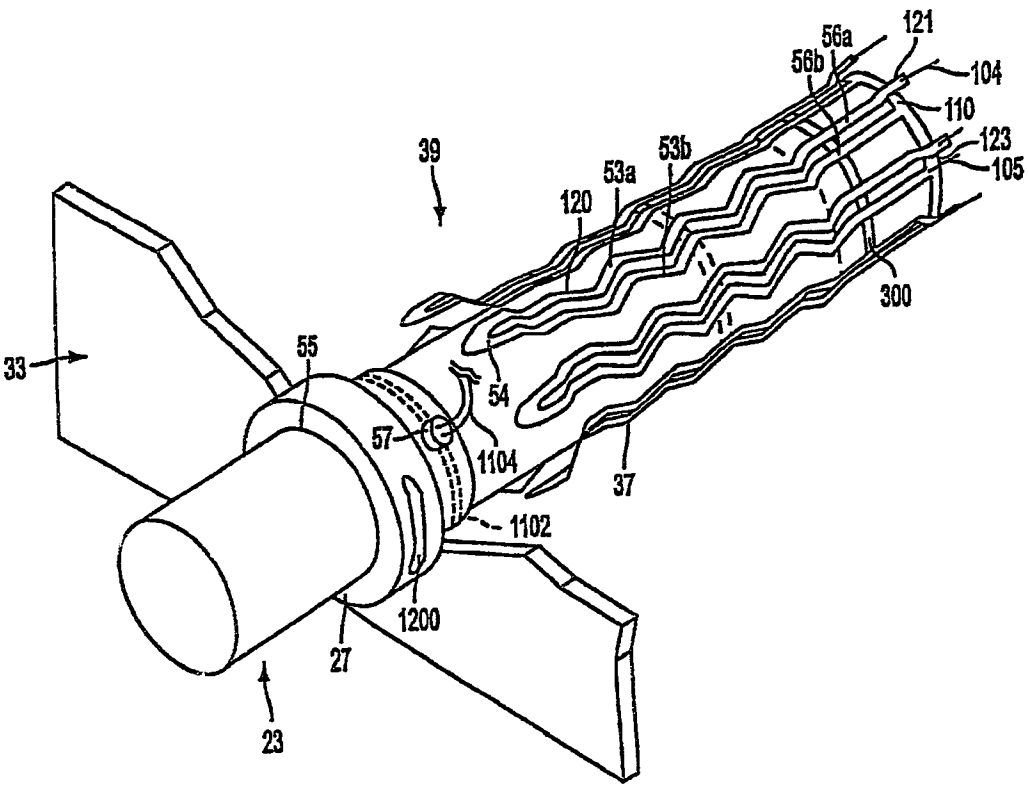
FIG. 6 illustrates a heater fixture of the electrical smoking system.

The lighter 25 includes a housing 31 having front and rear housing portions 33 and 35, respectively. A power source 35*a*, such as one or more batteries, is located within the rear housing portion 35 and supplies energy to a heater fixture 39. The heater fixture 39 includes a plurality of electrically resistive, heating elements 37 (FIG. 6). The heating elements 37 are arranged within the front housing portion 33 to receive the cigarette 23. A stop 183 located in the heater fixture 39 defines a terminal end of the cigarette receiver 27 (FIG. 2).

Control circuitry 41 in the front housing portion 33 selectively establishes electrical communication between the power source 35*a* and one or more of the heating elements 37 during each puff cycle.

The rear housing portion 35 of the housing 31 is constructed to be opened and closed to facilitate replacement of the power source 35*a*. It is noted that the front housing portion 33 can be removably attached to the rear housing portion 35 by mechanical engagement if desired.

Referring to FIG. 5, in an exemplary embodiment, the control circuitry 41 is activated by a puff-actuated sensor 45, which is sensitive to either changes in pressure or changes in the rate of air flow that occur upon initiation of a draw on the cigarette 23 by a smoker. The puff-actuated sensor 45 can be located within the front housing portion 33 of the lighter 25 and can communicate with a space inside the heater fixture 39 via a port 45*a* extending through a side wall portion 182 of the heater fixture 39. Once actuated by the sensor 45, the control circuitry 41 directs electric current to an appropriate one of the heating elements 37.

In an exemplary embodiment, an indicator 51 is provided at a location along the exterior of the lighter 25 to visually indicate the number of puffs remaining in a cigarette 23, or other selected information. The indicator 51 can include a liquid crystal display. In an exemplary embodiment, the indicator 51 displays a selected image when a cigarette detector 57 detects the presence of a cigarette in the heater fixture 39. The detector 57 can comprise any arrangement that senses the presence of an electrically heated cigarette. For example, the detector 57 can comprise an inductive coil 1102 adjacent the cigarette receiver 27 of the heater fixture 39 and electric leads 1104 that communicate the coil 1102 with an oscillator circuit within the control circuitry 41. In such case, the cigarette 23 can include a metallic element (not shown), which can affect inductance of the coil winding 1102 such that whenever a suitable cigarette 23 is inserted into the receiver 27, the detector 57 generates a signal to the circuitry 41 indicating the cigarette is present. The control circuitry 41 provides a signal to the indicator 51. When the cigarette 23 is removed from the lighter 25, the cigarette detector 57 no longer detects the presence of a cigarette 23 and the indicator 51 is turned off.

The heater fixture 39 supports an inserted cigarette 23 in a fixed relation to the heating elements 37 such that the heating elements 37 are positioned alongside the cigarette 23 at approximately the same location for each newly inserted cigarette 23. In an exemplary embodiment, the heater fixture 39 includes eight mutually parallel heater elements 37, which are disposed concentrically about the axis of symmetry of the cigarette receiver 27. The location where each heating element 37 touches a fully inserted cigarette 23 is referred to herein as the heater footprint or char zone 42.

As shown in FIG. 6, the heating elements 37 can each include at least first and second serpentine, elongate members 53*a* and 53*b* adjoined at a tip 54. The heater portions 53*a*, 53*b* and 54 form a heater blade 120. The tips 54 are adjacent the opening 55 of the cigarette receiver 27. The opposite ends 56*a* and 56*b* of each heating element 37 are electrically connected to the opposite poles of the power source 35*a* as selectively established by the controller 41. An electrical pathway through each heating element 37 is established, respectively; through a terminal pin 104, a connection 121 between the pin 104 and a free end portion 56*a* of one of the serpentine members 53*a*, through at least a portion of the tip 54 to the other serpentine member 53*b* and its end portion 56*b*. It is noted that a connection ring 110 can be used to provide a common electrical connection to each of the end portions 56*b*. In an exemplary embodiment, the ring 110 is connected to the positive terminal of the power source 35*a* through a connection 123 between the ring 110 and a pin 105.

The heating elements 37 can be individually energized by the power source 35*a* under the control of the control circuitry 41 to heat the cigarette 23 several times (i.e., eight times) at spaced locations about the periphery of the cigarette 23. The heating renders puffs (i.e., eight puffs) from the cigarette 23, as is commonly achieved with the smoking of a more traditional cigarette. It may be preferred to activate more than one heating element simultaneously for one or more or all of the puffs.

The heater fixture 39 includes an air inlet port 1200 through which air is drawn into the lighter. A pressure drop is induced upon the air entering the lighter such that the puff sensor 45 is operative to recognize initiation of a puff. The range of pressure drop induced is selected such that it is within the range of pressure drop detectable by the pressure sensor 45.

The length of the tobacco plug 80 and its relative position along the tobacco rod 60 can be selected based on the construction and location of the heating elements 37 of the electrical smoking system 21. When a cigarette 23 is properly positioned against a stop 183 (FIG. 2) within the lighter of the electrical smoking system, a portion of each heating element contacts the tobacco rod 60. This region of contact is referred to as a heater footprint 95, which is that region of the tobacco rod 60 where the heating element 37 is expected to reach a temperature high enough to allow smoking of the cigarette without combustion of the cigarette paper, mat, or tobacco. The heater foot print 95 can consistently locate along the tobacco rod 60 at the same predetermined distance 96 from the free end 78 of the tobacco rod 60 for every cigarette 23 that is fully inserted into the lighter 25.

The length of the tobacco plug 80 of the cigarette 23, the length of the heater footprint 95, and the distance between the heater footprint 95 and the stop 183 can be selected such that the heater footprint 95 extends beyond the tobacco plug 80 and superposes a portion of the void 91 by a distance 98. The distance 98 is also referred to as the "heater-void overlap" 98. The distance over which the remainder of the heater footprint 95 superposes the tobacco plug 80 is referred to as the "heater-filler overlap" 99.

The length of the void 91, tobacco plug 80, and the distribution of the perforation holes 263 may be adjusted to adjust the smoking characteristics of the cigarette 23, including adjustments in its taste, draw and delivery. The pattern of holes 263, the length of the void 90 and the amount of heater-filler overlap 99 (and heater-void overlap 98) may also be manipulated to adjust the immediacy of response, to promote consistency in delivery.

Electrically heated cigarettes according to exemplary embodiments can provide advantages. By encapsulating one or more added flavorings, especially volatile flavoring, the flavoring(s) can be retained in the cigarette until it is smoked. In addition, the flavoring can be temperature released in a controlled manner during smoking, thereby providing the smoker with an enhanced subjective characteristic of the cigarette. As the flavoring can be retained in the flavoring-release additive until the cigarette is smoked, deactivation of the sorbent in the cigarette is minimized. Consequently, the sorbent maintains it ability to remove selected gas phase constituents from mainstream smoke.

The exemplary embodiments may be embodied in other specific forms without departing from the spirit of the invention. Thus, while the exemplary embodiments have been illustrated and described in accordance with various exemplary embodiments, it is recognized that variations and changes may be made therein without departing from the exemplary embodiments as set forth in the claims.

The invention claimed is:

1. A smoking article comprising:

a tobacco rod including tobacco in a form of a tobacco plug and further includes an inner wrap, a tobacco mat, an over wrap, or any combination thereof surrounding the tobacco plug; and a flavoring-release additive present in or on at least one of the inner wrap, the tobacco mat, the over wrap, or the combination thereof, the flavoring-release additive including gamma cyclodextrin and a flavoring, the gamma cyclodextrin having a host ring structure, the flavoring including guest molecules incorporated within the host ring structure of the gamma cyclodextrin such that the guest molecules of the flavoring are configured to undergo a controlled release from the host ring structure of the gamma cyclodextrin upon exposure of the flavoring-release additive to heat, the flavoring is present in an amount of at least 30% by weight of the flavoring-release additive, and the flavoring-release additive is present in or on the at least one of the inner wrap, the tobacco mat, the over wrap, or the combination thereof in an amount of up to 8% by weight of the at least one of the inner wrap, the tobacco mat, the over wrap, or the combination thereof in or on which the flavoring-release additive is disposed.

2. The smoking article of claim 1, wherein the flavoring-release additive is in a form of a powder.

3. The smoking article of claim 2, wherein the powder has a particle size of about 1 nm to about 1 μm.

4. The smoking article of claim 2, wherein the powder is water-soluble.

5. The smoking article of claim 1, wherein the flavoring includes a lipophilic and organic compound.

6. The smoking article of claim 1, wherein the flavoring includes menthol, mint, chocolate, licorice, fruit flavors, gamma octalactone, vanillin, ethyl vanillin, breath freshener flavors, spice flavors, methyl salicylate, linalool, bergamot oil, geranium oil, lemon oil, ginger oil, tobacco flavor, or any combination thereof.

7. The smoking article of claim 6, wherein the smoking article is a cigarette and the flavoring is menthol.

8. The smoking article of claim 7, wherein the flavoring-release additive includes at least 30% menthol by weight and is configured to release at least about 34% of the menthol.

9. The smoking article of claim 1, wherein the flavoring-release additive further includes an encapsulating material, the encapsulating material including carrageenan, gelatin, agar, gellan gum, gum arabic, guar gum, xanthum gum, pectin, or any combination thereof.

10. The smoking article of claim 1, wherein the host ring structure of the gamma cyclodextrin defines a hydrophobic hole.

11. The smoking article of claim 1, wherein the host ring structure of the gamma cyclodextrin is composed of eight glucopyranose subunits.

12. The smoking article of claim 1, wherein the host ring structure of the gamma cyclodextrin is configured to open at a temperature of 200° C. or more to release guest molecules of the flavoring.

13. The smoking article of claim 1, wherein the flavoring-release additive is also present in the tobacco plug in an amount of about 10% to about 20% by weight of the tobacco.

14. The smoking article of claim 1, further comprising:

a sorbent configured to remove a gas-phase constituent of smoke.

15. The smoking article of claim 14, wherein the sorbent is selected from activated carbon, zeolite, or the combination of activated carbon and zeolite.

16. The smoking article of claim 15 wherein the sorbent is disposed on at least one of the inner wrap, the tobacco mat, the over wrap, or any combination thereof.

17. The smoking article of claim 14, further comprising:

a filter in communication with the tobacco rod and the sorbent disposed on the filter.

* * * * *